US006287755B1

(12) United States Patent
Shima et al.

(10) Patent No.: US 6,287,755 B1
(45) **Date of Patent: *Sep. 11, 2001**

(54) THERMALLY DEVELOPABLE PHOTOSENSITIVE MATERIAL

(75) Inventors: Tetsuo Shima; Tadahiro Nagasawa, both of Hino (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/295,460

(22) Filed: Apr. 14, 1999

(30) Foreign Application Priority Data

Apr. 20, 1998 (JP) ..... 10-125295

(51) Int. Cl.[7] ..... G03C 1/498
(52) U.S. Cl. ..... 430/619; 430/604
(58) Field of Search ..... 430/619, 604, 430/567, 350

(56) References Cited

U.S. PATENT DOCUMENTS 4,618,574 * 10/1986 Cavallaro ..... 430/567
4,725,534 2/1988 Kagami et al. .
4,849,396 7/1989 Satake et al. .
5,998,127 * 12/1999 Toya et al. ..... 430/619

FOREIGN PATENT DOCUMENTS 0248405 2/1987 (EP) .
0919862 2/1999 (EP) .

OTHER PUBLICATIONS

European Search Report EP 99 30 2982.

* cited by examiner

*Primary Examiner*—Thorl Chea
(74) *Attorney, Agent, or Firm*—Jordan B. Bierman; Bierman, Muserlian and Lucas

(57) ABSTRACT

A thermally developable photosensitive material comprising photosensitive silver halide grains, an organic silver salt, a reducing agent and a binder, characterized in that a dispersibility ((standard deviation of circle equivalent diameter of cell)/(average value); cell centering each grain is obtained by processing an electron microscope image employing an extension method) of said photosensitive silver halide grains having grain size of not less than 0.02 $\mu$m, measured from an expopsing side of said thermally developable photosensitive material, is not more than 80%.

18 Claims, No Drawings

THERMALLY DEVELOPABLE PHOTOSENSITIVE MATERIAL

FIELD OF THE INVENTION

The present invention relates to a thermally developable photosensitive material and specifically to the thermally developable photosensitive material having high sensitivity when exposed by a laser imager or a laser image setter with an excellent image stability after development.

BACKGROUND OF THE INVENTION

Conventionally, in the printing and plate-making field and the medical field, solution waste generated along with the wet process for image forming materials has caused problems regarding workability, and in recent years, a decrease in the processing solution waste has been strongly demanded in terms of environmental protection and room saving. Thus, a technique for light heat photographic material for a technical photographic use is demanded in which exposure can be sufficiently carried out using a laser image setter or a laser imager, and sharp and bright images with high resolving power can be achieved. As such techniques, methods are well known which are described, for example, in U.S. Pat. Nos. 3,152,904 and 3,487,075 and D. Morgan, î Dry Silver Photographic Materialsî (Handbook of Imaging Materials, Marcel Dekker, Inc. page 48, 1991), etc. These photosentive materials are referred to as thermally developable photosensitive materials comprising a support having thereon an organic silver salt, a photosensitive silver halide and a reducing agent.

Conventionally, these thermally developable photosensitive materials are characterized in that they are thermally developed at temperature of 80 to 140° C. so as to obtain images without fixation, so that the silver halide and the organic silver salt in an unexposed portion are not removed and remain in the photosensitive materials.

Accordingly, the remaining silver halide and organic silver salt cause an increase of fog in the unexposed portion, staining the unexposed portion and discoloring an image tone of the developed silver into a warm black tone when storing the photosensitive materials for a long time. Specifically, in cases where an amount of silver is increased to obtain a sufficient image density available for a practical use, there exists a problem that diagnosis ability is lowered because of the increase of fog, so that the thermally developable photosensitive material with small amount of silver by which high light-sensitivity and high image density are attained has been desired.

SUMMARY OF THE INVENTION

Accordingly, in view of the foregoing, the present invention was accomplished. An object of the invention is to provide the thermally developable photosensitive material with high sensitivity when exposed and high image density.

DETAILED DESCRIPTION OF THE INVENTION

Above objects of the invention could be attained by the following constitution:

1. A thermally developable photosensitive material comprising photosensitive silver halide grains, an organic silver salt, a reducing agent and a binder, characterized in that a dispersibility ((standard deviation of circle equivalent diameter of cell)/(average value); cell centering each grain is obtained by processing an electron microscope image employing an extension method) of said photosensitive silver halide grains having grain size of not less than 0.02 μm, measured from an expopsing side of said thermally developable photosensitive material, is not more than 80%.

2. The thermally developable photosensitive material of item 1, wherein previously prepared photosensitive silver halide grains mixed with said organic silver salt are monodispersed silver halide grains.

3. The thermally developable photosensitive material of item 1, wherein a photosensitive layer contains zirconium in an amount of 0.005 to 0.5 mg per 1 g of silver.

4. The thermally developable photosensitive material of item 1, wherein said thermally developable photosensitive material contains 5 to 1000 mg/m$^2$ of solvent.

5. A thermally developable photosensitive material comprising photosensitive silver halide grains, an organic silver salt, a reducing agent and a binder, characterized in that not less than 95% of said photosensitive silver halide grains having grain size of not less than 0.02 μm is in contact with said organic silver salts.

6. The thermally developable photosensitive material of item 5, wherein previously prepared photosensitive silver halide grains mixed with said organic silver salt are monodispersed silver halide grains.

7. The thermally developable photosensitive material of item 5, wherein a photosensitive layer contains zirconium in an amount of 0.01 to 0.5 mg per 1 g of silver.

8. The thermally developable photosensitive material of item 5, wherein said thermally developable photosensitive material contains 5 to 1000 mg/m$^2$ of solvent.

The embodiments of the present invention are detailed below.

Silver halide grains of photosensitive silver halide in the present invention work as a light sensor. In order to minimize translucence after image formation and to obtain excellent image quality, the less the average grain size, the more preferred, and the average grain size is preferably less than 0.1 μm; is more preferably between 0.01 and 0.1 μm, and is most preferably between 0.02 and 0.08 μm. Herein, the grain size indicates a diameter of circle (circle equivalent diameter) having equal area to that of each grain image observed with a transmission electron microscope.

Furthermore, silver halide grains are preferably monodisperse grains. The monodisperse grains as described herein refer to grains having a monodispersibility obtained by the formula described below of less than 40%; more preferably less than 30%, and most preferably between 0.1 and 20%.

$$\text{Monodispersibility}=(\text{standard deviation of grain diameter})/(\text{average of grain diameter})\times 100$$

There is no limitation as to the silver halide grain shape, but the silver halide grain shape in which a high ratio of a Miller index [100] plane occupies is preferred. This ratio is preferably at least 50%; is more preferably at least 70%, and is most preferably at least 80%. The ratio occupying the Miller index [100] plane can be obtained based on T. Tani, J. Imaging Sci., 29, 165 (1985) in which adsorption dependency of a [111] plane and a [100] plane is utilized.

Furthermore, another preferred silver halide shape is a tabular grain. The tabular grain as described herein is a grain having an aspect ratio represented by r/h of at least 3, wherein r represents a grain diameter in μm obtained as the square root of the projection area, and h represents thickness in μm in the vertical direction. Of these, the aspect ratio is preferably between 3 and 50.

The grain diameter is preferably not more than 0.1 μm, and is more preferably between 0.01 and 0.08 μm. These are described in U.S. Pat. Nos. 5,264,337, 5,314,789, 5,320,958, and others.

The composition of silver halide may be any of silver chloride, silver chlorobromide, silver chloroiodobromide, silver bromide, silver iodobromide, or silver iodide.

The photographic emulsion employed in the present invention can be prepared employing methods described in P. Glafkides, ı Chimie et Physique Photographiquel̂ (published by Paul Montel Co., 1967), G. F. Duffin, ı Photographic Emulsion Chemistryî (published by The Focal Press, 1966), V. L. Zelikman et al., ı Making and Coating Photographic Emulsionî (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed.

Silver halide employed in the present invention is preferably comprised of ions of metals or complexes thereof, in transition metal belonging to Groups VIB, VIIB, VIII and IB of the Periodic Table. As the above-mentioned metals, preferred are Cr and W (in Group VIB); Re (in Group VIIB); Fe, Co, Ni, Ru, Rh, Pd, Os, Ir, and Pt (in group VIII); and Cu and Au (in Group IB). Of these, when employed for printing plate-making photosensitive materials, it is preferred to use Rh, Re, Ru, Ir, or Os.

These metals may be incorporated into silver halide in the form of complexes. In the present invention, regarding the transition metal complexes, six-coordinate complexes represented by the general formula described below are preferred.

General formula $$(ML_6)^m$$

wherein M represents a transition metal selected from elements in Groups VIB, VIIB, VIII, and IB of the Periodic Table; L represents a coordinating ligand; and m represents 0, −1, −2, or −3.

Specific examples represented by L include halides (fluorides, chlorides, bromides, and iodides), cyanides, cyanates, thiocyanates, selenocyanates, tellurocyanates, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)_2]^{2-}$
9: $[Ru(NO)(H_2O)Cl_4]^{-}$
10: $[RhCl_5\ (H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. The addition may be carried out several times by dividing the added amount. Uniform content in the interior of a silver halide grain can be carried out. As described in Japanese Patent Publication Open to Public Inspection (hereinafter referred to as JP-A) Nos. 63-29603, 2-306236, 3-167545, 4-76534, 6-110146, 5-273683, etc., incorporation can be carried out so as to result in distribution formation in the interior of a grain. These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

The photosensitive silver halide grains according to the invention preferably distribute uniformly on the exposing side of the thermally developable photosensitive material so that each silver halide grain functions sufficient as a light sensor.

The present invention is characterized in that with respect to the photosensitive silver halide grains having grain size of not less than 0.02 μm, measured from an expopsing side of the thermally developable photosensitive material, a dispersibility ((standard deviation of circle equivalent diameter of cell)/(average value); cell centering each grain is obtained by processing an electron microscope image employing an extension method) is not more than 80%.

The dispersibility according to the invention can be concretely determined according to the following manner. Thus, a light-sensitive layer coated on a support is pasted on a suitable holder using an adhesive agent so that an ultra thin section of which thickness is 0.1 to 0.2 μm is prepared by slicing the light-sensitive layer in the direction parallel to the support using a diamond knife. In this operation, one must confirm that the slicing is carried out nearly parallel to the support by observing an upper side and a lower side of the light-sensitive layer using an optical microscope, namely, one must confirm that the slicing is carried out with a slicing angle of not more than 1 degree.

Thus obtained ultra thin section is supported by a copper mesh and placed onto a carbon membrane subjected to a hydrophilic treatment by glow discharge, then a light visual image of the sample slice is observed at a magnification of ×5,000 to ×40,000 with a transmission electron microscope (hereinafter referred to as TEM) while cooled with liquid nitrogen to not higher than −130° C., and the above observed image is rapidly recorded using a film, an imaging plate and a CCD camera, etc. In this case, it is preferable that an observed visual field is suitably selected so that the sample section does not have any breach and shrinkage.

As a carbon membrane, it is preferable to use the carbon membrane supported by an organic membrane such as an extremely thin collodion or formvar, and it is more preferable to use a single carbon membrane which is obtained in the following manners; (i) forming the carbon membrane on a rock salt base, and thereafter obtaining single carbon membrane by dissolving the rock salt base to be removed, (ii) obtaining single carbon membrane by dissolving the above-mentioned organic membrane to be removed by an organic solvent or an ion-etching.

As an accelerating voltage of TEM, it is preferably 80 to 400 kV, more preferably 80 to 200 kV.

The details of the observing technique of an electron microscope and the preparing technique of the samples can be referred to [Nihon Denshikenbikyo Gakkai Kantoshibuhen; Igaku Seibutugaku Denshikenbikyo Kansatsuhou (The Society of Microscopic Science and Technology of Japan; The Observation Technique of Electron Microscope on Medical Science-Biology)] (published by Maruzen), [Nihon Denshikenbikyo Gakkai Kantoshibuhen; Denshikenbikyo Seibutsushiryo Sakuseihou (The Society of Microscopic Science and Technology of Japan; The Preparing Technique of Electron Microscopic Biological Sample)] (published by Maruzen).

One sheet of a TEM image which is recorded by a suitable recording medium is divided into at least 1024 pixels×1024 pixels, preferably not less than 2048 pixels×2048 pixels, and is preferably subjected to an image processing by a computer.

To carry out the image processing, an analog image recorded in the film is converted into an digital image by a scanner, etc., if necessary, a shading correction and a contrast edge emphasis, etc. are preferably made. Thereafter, making a histogram and treating by binary coding, portions corresponding to silver halide grains are abstracted. Grains which unavoidably agglomerate are cut off by a suitable algorithm and grains having circle equivalent diameter of less than 0.02 μm are eliminated. Next, the central point of each grain is obtained, and by extending each pixel from around the above obtained central point until each pixel is in contact with another pixel with each other, cells are formed around the central points. In this case, the cells which lie on a measuring frame are eliminated, and the circle equivalent diameter of each cell is obtained. In the similar manner to the above-mentioned manner, as to at least 500 cells, preferably not less than 1000 cells, the circle equivalent diameters are obtained, and from these values average value and standard deviation are calculated, then dispersibility is obtained according to the following formula.

$$\text{Dispersibility} = (\text{Standard deviation of circle equivalent diameter of cell}) / (\text{average value of circle equivalent diameter of cell}) \times 100$$

In cases where the measurement is carried out according to the aforesaid procedure, a length correction (scale correction) per one pixel and a two-dimensional distortion correction of a measuring system are sufficiently made in advance. As a standard sample, uniform latex-particles (DULP) produced by Dow Chemical Co., Ltd. is in the market and suitable, and polystyrene particles having less than 10% of variation coefficient to a particle diameter of 0.1 to 0.3 μm are preferable, concretely it is possible to obtain a lot with the particle diameter of 0.212 μm and the standard deviation of 0.0029 μm.

The details of image processing technique can be referred to [Gazoshorioyogijutu (Kogyochosakai), (Image Processing Application Technique (Industrial Investigation Society))] edited by Hiroshi Tanaka, and there is no limitation to use an image processing program or apparatus, for example, is cited Luzex-III produced by Nireco Co., Ltd.

There is no limitation to enhance the dispersibility of the photosensitive silver halide, but to optimize various conditions is effective when organic silver soap is mixed and/or dried soap is dispersed. When the photosensitive silver halide is mixed with the organic silver soap, a dispersion mixer having a structure capable of rapid stirring is preferable in intercepted state from the exterior, specifically mechanical high-frequency dispersion equipment described in K. Kuchta and L. F. Witt, Jr., [Mechanical high-frequency dispersion equipment], published by μmerican Laboratory, June (1973) is preferable. The mechanical high-frequency dispersion equipment is composed of a rotor and a stator rotating at high speed around a concentric circle and the mechanical high-frequency dispersion equipment is preferably operated in the range of 12 kHz to 240 MHz of the mechanical vibration frequency determined by shape and rotational number of the rotor and stator.

In the invention, the photosensitive silver halide grains may be not desalted after forming the grains, but in cases where desalting is carried out, the grains can be desalted by employing well known washing methods in this art such as a noodle method and a flocculation method, etc.

The photosensitive silver halide grains used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A No. 7-128768 is usable. Examples of useful tellurium sensitizers include diacyltellurides, bis(oxycarbonyl)tellurides, bis(carbamoyl) tellurides, bis(oxycarbonyl)ditellurides, bis(carbamoyl) ditellurides, compounds containing P═Te bond, tellurocarboxylic acids, Te-organictellurocarboxylic acid esters, di(poly)tellurides, tellurides, tellurols, telluroacetals, tellurosulfonates, compounds containing P—Te bond, Te containing heterocyclic ring compounds, tellurocarbonyl compounds, inorganic tellurium compounds and colloidal tellurium, etc. Examples of the compounds used in the noble metal sensitization include chloroauric acid, potassium chloroaurate, potassium aurithiocyanate, gold sulfide, gold selenide, compounds described U.S. Pat. No. 2,448,060 and British Patent No. 618,061.

Examples of the compounds used in the reduction sensitization include ascorbic acid, thiourea dioxide, stannous chloride, aminoiminomethanesulfinic acid, hydrazine derivatives, borane compounds, silane compounds and polyamine compounds.

The reduction sensitization can be carried out by ripening an emulsion of which pH and pAg are kept to not less than 7 and not more than 8.3 respectively. Furthermore, the reduction sensitization can be carried out by introducing a single addition part of silver ion during the grains being formed.

In the present invention, organic silver salts are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocylic rings. Organic or inorganic silver salt complexes are also useful in which the ligand has a total stability constant for silver ion of 4.0 to 10.0. Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these, the preferred silver salts are silver behenate, silver arachidinate and silver stearate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc. For example, after an organic alkaline metal salt soap (e.g., sodium behenate, sodium arachidinate, etc.) is prepared by adding an organic acid to an alkaline metal salt (e.g., sodium hydroxide, potassium hydroxide, etc.), the above-mentioned soap and silver nitrate are mixed to produce crystals of the organic silver salt. Preparing the organic silver salt may be performed in the presence of silver halide.

In the present invention, organic silver salts have an average grain diameter of 1 $\mu$m and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. Furthermore, the monodisperse as described herein is the same as silver halide grains and preferred monodispersibility is between 1 and 30%. In the present invention, the organic silver salts are preferably composed of monodispersed grains with an average diameter of not more than 1 $\mu$m. When grains are prepared within this range, high density images can be obtained. Furthermore, the tabular grains preferably occupy not less than 60% of all the organic silver salt. In the present invention, the tabular grain is the grain of which ratio of an average size to a thickness, that is, an aspect ratio (abbreviated as AR), is not less than 3.

$$AR=(\text{average size } (\mu m))/(\text{thickness } (\mu m))$$

As a method of obtaining the organic silver salt grains having the shape of the present invention, there is no limitation thereto, but optimization of various kinds of conditions such as mixing state when forming an organic acid alkaline metal salt soap and/or mixing state when adding silver nitrate to said soap is effective. The organic silver grains of the present invention, if necessary, are preliminarily dispersed in the presence of a binder and a surfactant, thereafter are preferably dispersed and pulverized employing a medium dispersion equipment or a high pressure homogenizer. In the above-mentioned preliminary dispersion, general stirrers such as an anchor type stirrer and a propeller type stirrer, high speed rotational centrifugal radiating type stirrer (dissolver) and high speed rotational shearing type stirrer (homomixer) can be employed. As the above-mentioned medium dispersion equipment, a fluidized-bed mill such as a ball mill, a planet ball mill, a vibration ball mill and a medium stirring mill such as a bead mill, an attriter and a basket mill can be employed. As the high pressure homogenizer, various types can be used, in one of which a dispersion solution is collided against wall and plug, in another one of which the dispersion solution is divided into plural parts so that each solution is collided at high speed with each other, in last one of which the dispersion solution is passed through narrow orifice. In the equipments used in dispersing the organic silver grains of the present invention, as the quality of the material contacting with said organic silver grains, ceramics such as zirconia, alumina, silicon nitride, boron nitride and/or diamond are preferably used, specifically preferable one is zirconia. The organic silver grains of the present invention preferably contain 0.005 to 0.5 mg of zirconium per 1 g of silver, specifically preferably 0.005 to 0.3 mg of zirconium. It is very preferable to optimize binder concentration, preliminary dispersing method, dispersing equipment operation condition and rotational number in conducting the above mentioned dispersion.

In the present invention, to prevent devitrification of the photosensitive material, the sum total of silver contained in both the photosensitive silver halide and the organic silver salt is preferably 0.5 to 2.2 g per $m^2$. When silver grains are prepared within this range, high contrast images can be obtained. Ratio of an amount of the photosensitive silver halide to the sum total of silver is preferably not more 50 wt %, more preferably not more 25 wt %, specifically preferably within 0.1 wt % to 15 wt %. The silver halide can be added to the organic silver salt dispersion employing any method and it is preferred to arrange the silver halide grains in the vicinity of the organic silver salts.

Furthermore, the present invention is characterized in that not less than 95% of the photosensitive silver halide grains having grain size of not less than 0.02 $\mu$m is in contact with the organic silver salts. In this case, arrangement of the organic silver salts and the photosensitive silver halide grains can be confirmed by observing an ultra thin slice having thickness of 0.1 to 0.2 $\mu$m while cooled to not higher than −130° C. with TEM. Said ultra thin slice is made by sandwiching the photosensitive layer coated on a support between suitable holders and cutting the photosensitive layer in the perpendicular direction to the support using a diamond knife. In the present invention, the contact indicates that the distance between the organic silver grain and the photosensitive silver halide grain is not more than 2 nm when a photographed light visual image is enlarged at a magnification factor of 20,000 to 50,000 times. It is preferable to measure the existence of the contact with respect to at least 500, preferably not less than 1000 photosensitive silver halide grains having circle equivalent diameter of not less than 0.02 $\mu$m.

There is no limitation to bring the photosensitive silver halide grains in close contact with the organic silver salt grains, but it is effective to optimize some conditions when organic soap is mixed and/or dried soap is dispersed and/or additives are added.

A reducing agent is preferably incorporated into the thermally developable photosensitive material to which the present invention is applied. Examples of suitable reducing agents are described in U.S. Pat. Nos. 3,770,448, 3,773,512, and 3,593,863, and Research Disclosure Items 17029 and 29963, and include the following. Aminohydroxycycloalkenone compounds (for example, 2-hydroxypiperidino-2-cyclohexane); esters of amino reductones as the precursor of reducing agents (for example, pieridinohexose reduction monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

As hindered phenols, listed are compounds represented by the general formula (A) described below.

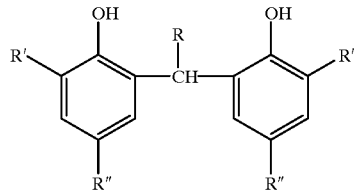

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

A-1

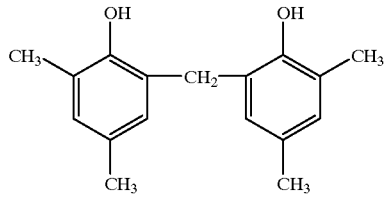

A-2

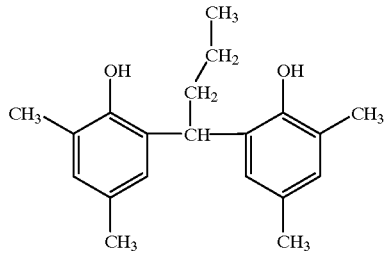

A-3

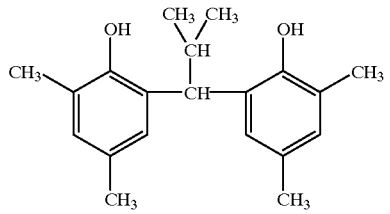

-continued

A-4

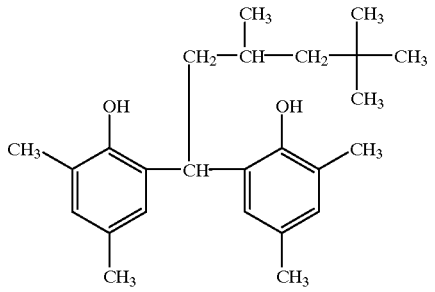

A-5

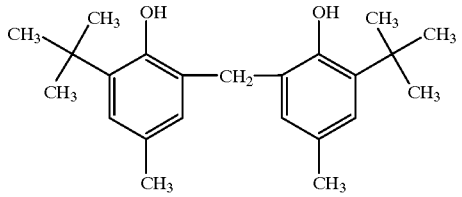

A-6

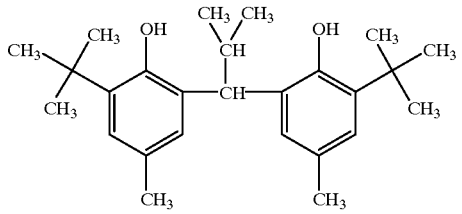

A-7

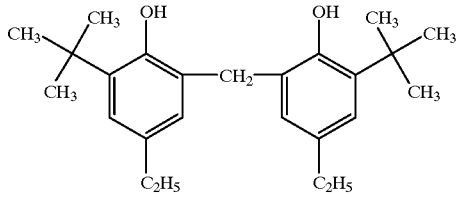

The used amount of reducing agents first represented by the above-mentioned general formula (A) is preferably between $1\times10^{-2}$ and 10 moles per mole of silver, and is most eferably between $1\times10^{-2}$ and 1.5 moles.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0030] to [0036] of JP-A No. 9-288328. Further, as another examples of suitable antifoggants, employed preferably are compounds described in paragraph numbers [0062] and [0063] of JP-A No. 9-90550. Furthermore, other suitable antifoggants are disclosed in U.S. Pat. No. 5,028,523, and U. K. Patent Application Nos. 92221383. No. 4, 9300147. No. 7, and 9311790. No. 1.

Image color control agents are preferably incorporated into the thermally developable photosensitive material according to the present invention for the purpose of improving the silver image color after development. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,Ní-hexamethylene(1-carbamoyl-3,5-dimethylpyrazole), 1,8-(3,6-dioxaoctane)bis (isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the thermally developable photosensitive material to which the present invention is applied, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in JP-A Nos. 9-34078, 9-54409, and 9-80679.

In the present invention, to restrain or accelerate development for the purpose of controlling the development, to enhance the spectral sensitive efficiency, and to enhance the reservation stability before and after the development, a mercapto compound, a disulfide compound and a thione compound can be incorporated in the photosensitive material. In cases where the mercapto compound is used in the present invention, any compound having a mercapto group can be used, but preferred compounds are represented by the following formulas, Ar—SM and Ar—S—S—Ar, wherein M represents a hydrogen atom or an alkaline metal atom, Ar represents an aromatic ring compound or a condensed aromatic ring compound having at least a nitrogen, sulfur, oxygen, selenium or tellurium. Preferable heteroaromatic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These heteroaromatic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms).

Examples of mercapto-substituted heteroaromatic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole, but the exemplified compounds according to the present invention are not limited thereto.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 30% in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U. K. Patent No. 1.173,181, etc. Regarding organic substances, as organic matting agents those can be employed which are starch described in U.S. Pat. No. 2,322,037, etc.; starch derivatives described in Belgian Patent No. 625,451, U. K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent.

The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50%, is more preferably not more than 40%, and is most preferably not more than 30%.

The variation coefficient of the size distribution as described herein is a value represented by the formula described below.

(Standard deviation of grain diameter)/(average grain diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface. Addition methods of the matting agent according to the present invention include those in which a matting agent is previously dispersed into a coating composition and is then coated, and prior to the completion of drying, a matting agent is sprayed. When a plurality of matting agents are added, both methods may be employed in combination.

In the present invention, specifically, when the thermally developable photosensitive material is employed for the output of a printing image setter with an oscillating wavelength of 600 to 800 nm, hydrazine derivatives are preferably incorporated into the photosensitive material.

As hydrazine derivatives employed in the present invention, preferred are those having the following general formula (H).

General formula (H)

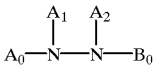

[Wherein $A_0$ represents an aliphatic group, an aromatic group, a $C_0$—$D_0$ group, or a heterocyclic group, each of which may have a substituent; $B_0$ represents a blocking group; both $A_1$ and $A_2$ represent hydrogen atoms, or one of which represents a hydrogen atom and the other represents an acyl group, a sulfonyl group or an oxalyl group. $C_0$ represents a —CO— group, a —COCO— group, a —CS— group, a —C(=$NG_1D_1$)— group, a —SO— group, a —$SO_2$— group or a —P(O)($G_1D_1$)— group; $G_1$ represents a simple linking groups, a —O— group, —S— group, or —N($D_1$)— group; $D_1$ represents an aliphatic group, an aromatic group, a heterocyclic group, or a hydrogen atom; and $D_0$ represents a hydrogen atom, an aliphatic group, an aromatic group, a heterocyclic group, an amino group, an alkoxy group, an aryloxy group, an alkylthio group, or an arylthio group.]

In general formula (H), aliphatic groups represented by $A_0$ preferably have from 1 to 30 carbon atoms, and straight, branched or cyclic alkyl groups having from 1 to 20 carbon atoms are particularly preferred and, for example, cited are a methyl group, an ethyl group, a t-butyl group, an octyl group, a cyclohexyl group, and a benzyl group. These may be substituted with a suitable substituent (for example, an aryl group, an alkoxy group, an aryloxy group, an alkylthio group, arylthio group, a sulfoxy group, a sulfonamido group, a sulfamoyl group, an acylamino group, a ureido group, etc.).

In the general formula (H), aromatic groups represented by $A_0$ are preferably monoring or condensed ring aryl groups, and cited, for example, are a benzene ring and a naphthalene ring. Heterocyclic groups represented by $A_0$ are preferably monoring or condensed ring groups composed of a heterocycle containing at least one hetero atom selected from nitrogen, sulfur, and oxygen atoms, which are, for example, a pyrrolidone ring, an imidazole ring, a tetrahydrofuran ring, a morpholine ring, a pyridine ring, a pyrimidine ring, a quinoline ring, a thiazole ring, a benzothiazole ring, a thiophene ring, or a furan ring; as $A_0$, those particularly preferred are an aryl group and a heterocyclic group, and aromatic groups and heterocyclic groups of $A_0$ may have a substituent and particularly preferred groups include a substituent having an acidic group with a pKa of 7 to 11, and specifically cited are a sulfonamido group, a hydroxyl group, a mercapto group, etc.

In the general formula (H), the —$G_0$—$D_0$— group represented by $A_0$ will now be described.

$G_0$ represents a —CO— group, a —COCO— group, a —CS— group, a —C(=$NG_1D_1$)— group, a —SO— group, a —$SO_2$— group, or a —P(O)($G_1D_1$)— group, and as preferred $G_0$, listed are a —CO— group and a —COCO— group, and as particularly preferred, a —COCO— group is listed. $G_1$ represents a simple linking group, a —O— group, a —S— group or a —N($D_1$)— group, and $D_1$ represents an aliphatic group, an aromatic group, a heterocyclic group, or a hydrogen atom, and when a plurality of $D_1$s are present in a molecule, these may be the same or different.

$D_0$ represents a hydrogen atom, an aliphatic group, an aromatic group, a heterocyclic group, an amino group, an alkoxy group, an aryloxy group, an alkylthio group, an arylthio group, and as preferred $D_0$, listed are a hydrogen atom, an alkyl group, an alkoxy group, an amino group, an aryl group, etc.

Furthermore, in the general formula (H), $A_0$ preferably contains at least one of a nondiffusion group or a silver halide adsorption group. As the nondiffusion group, a ballast group is preferred which is commonly used as immobilizing photographic additives such as couplers, and the ballast groups include an alkyl group, an alkenyl group, an alkynyl group, an alkoxy group, a phenyl group, a phenoxy group, an alkylphenoxy group, etc. which have at least 8 carbon atoms and are photographically inactive.

In the general formula (H), silver halide adsorption accelerators include thiourea, a thiourethane group, a mercapto group, a thioether group, a thione group, a heterocyclic groups, a thioamido heterocyclic group, a mercapto heterocyclic group, or adsorption groups described in JP-A No. 64-90439.

In the general formula (H), $B_0$ represents a blocking group; preferably represents —$G_0$—$D_0$ which is the same as the —$G_0$—$D_0$ group in $A_0$, and $A_0$ and $B_0$ may be the same or different.

Both $A_1$ and $A_2$ represent a hydrogen atom and when one of them represents a hydrogen atom, the other represents an acyl group (for example, an acetyl group, a trifluoroacetyl group, a benzoyl group, etc.), a sulfonyl group (for example, a methanesulfonyl group, a toluenesulfonyl group, etc.), or an oxalyl group (for example, an ethoxalyl group, etc.).

Specific examples represented by the general formula (H) are described below. However, the present invention is not limited to these examples.

H-1

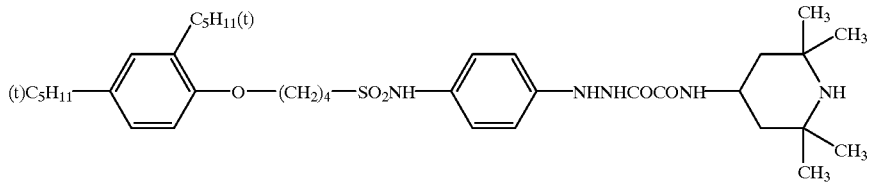

H-2

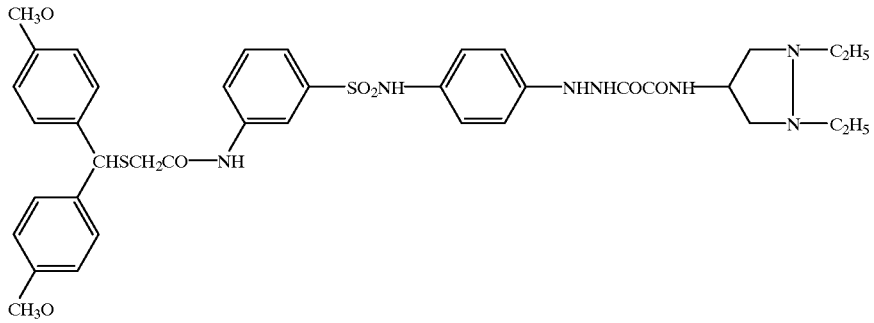

H-3

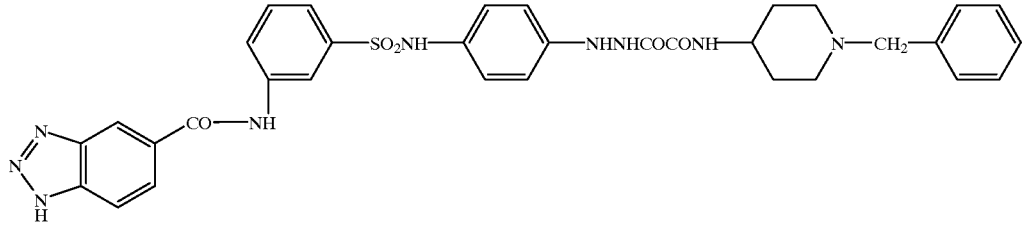

-continued
H-4
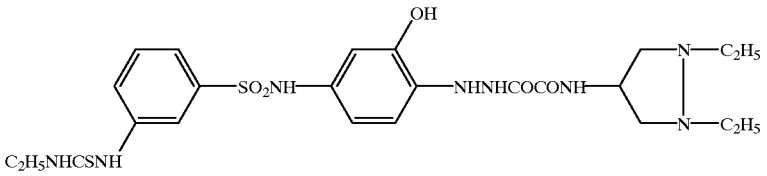
H-5
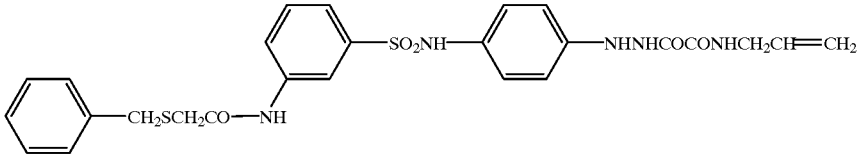
H-6
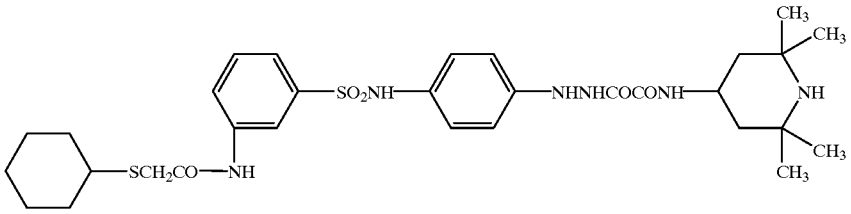
H-7
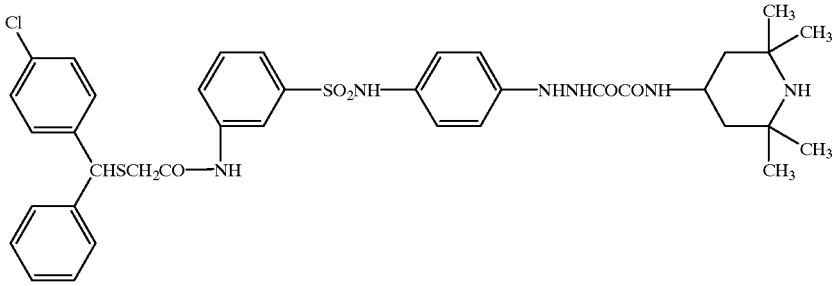
H-8
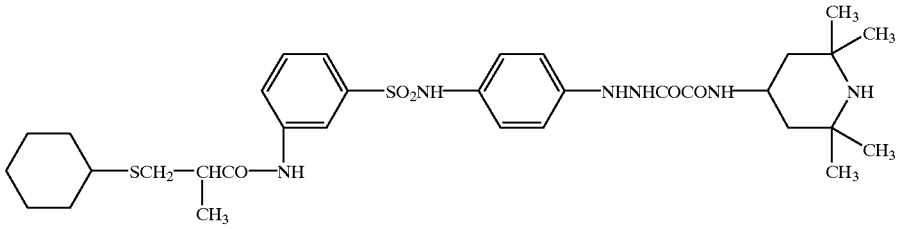
H-9
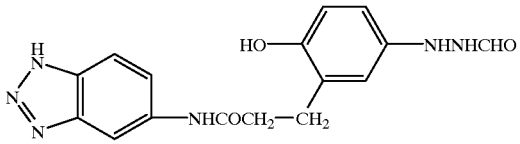
H-10
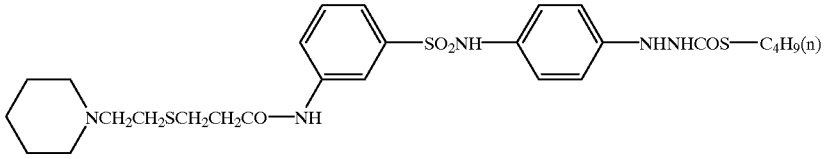
H-11
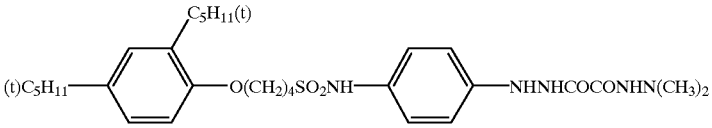

-continued
H-12
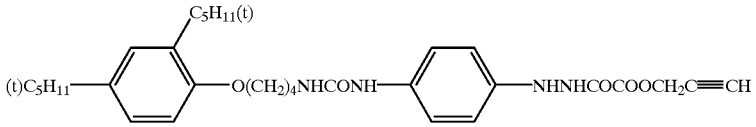
H-13
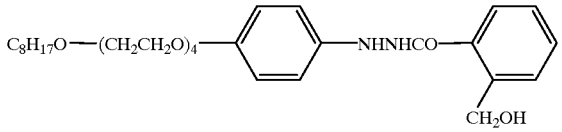
H-14
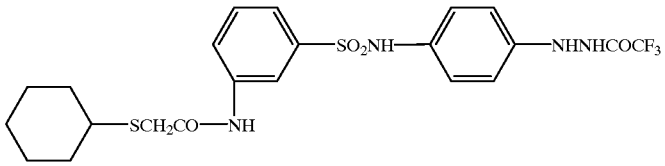
H-15
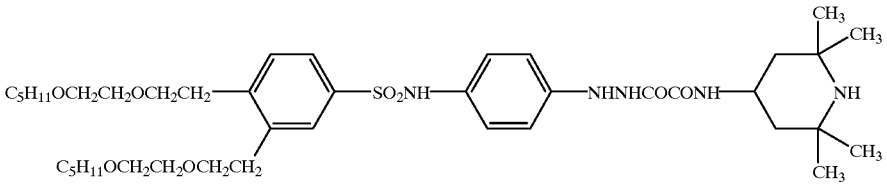
H-16
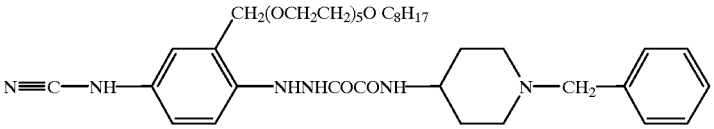
H-17
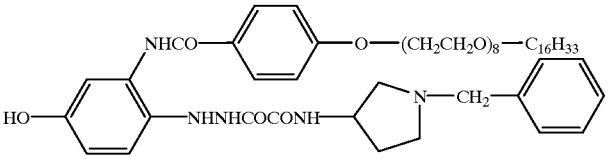
H-18
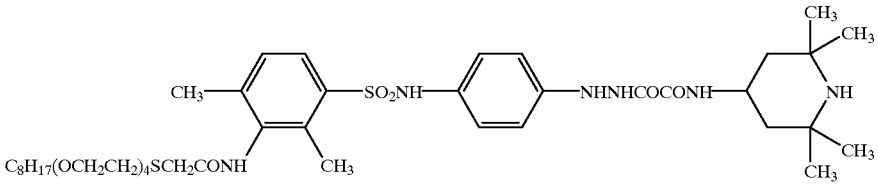
H-19
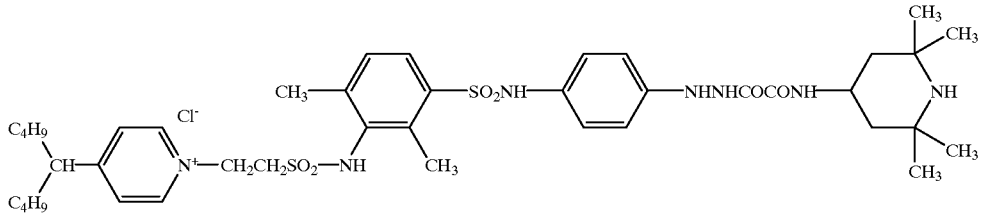
H-20
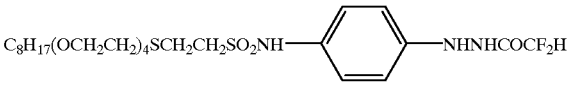

-continued
H-21
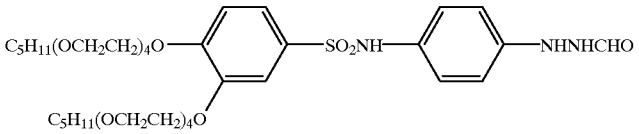
H-22
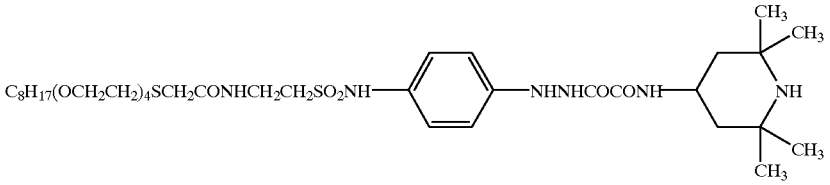
H-23
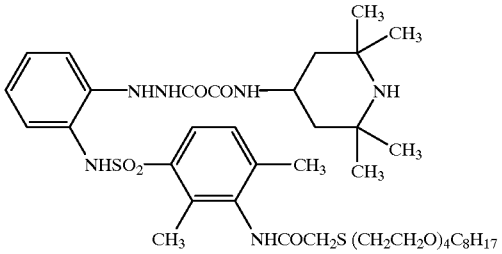
H-24
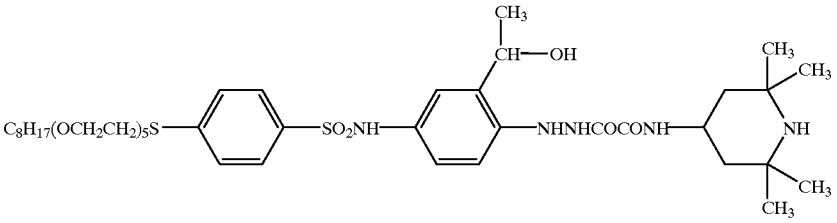
H-25
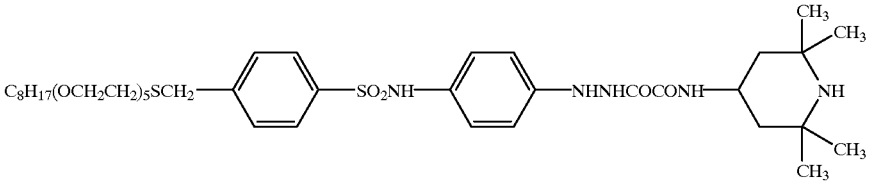
H-26
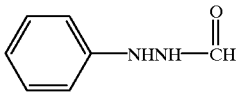
H-27
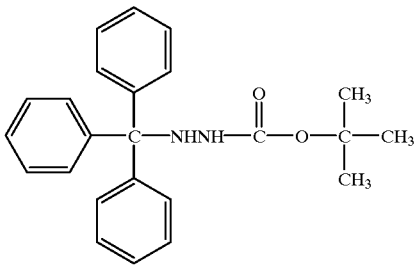
H-28
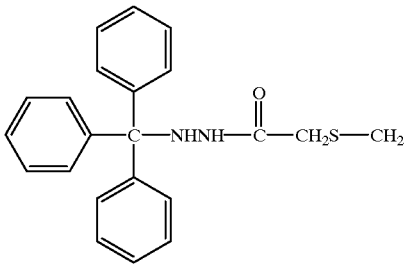
H-29
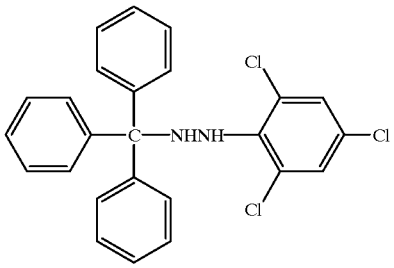

-continued

H-30

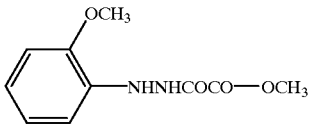

H-31

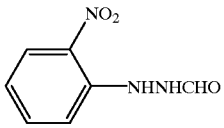

H-32

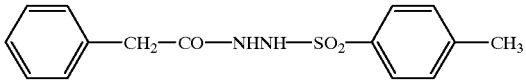

As hydrazine compounds employed in the present invention, other than the compounds described above, those described below may also be employed.

In addition to the compounds described in Research Disclosure, Item 23516 (November 1983 Issue, page 345) and publications cited therein, listed can be those described in U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; U. K. Patent No. 2,011,391B; European Patent Nos. 217,310, 301,799, and 356,898; and JP-A Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164, etc.

Furthermore, other than those, employed can be compounds described in (Ka 1) of Japanese Patent Publication No. 6-77138, specifically, compounds described on pages 3 and 4 of the Publication; compounds represented by general formula (I) in Japanese Patent Publication No. 6-93082, specifically, compounds 1 through 38 described on pages 8 to 18 of the Publication; compounds represented by general formula (4), general formula (5), and general formula (6) in Japanese Patent Publication Open to Public Inspection No. 6-230497, specifically, compounds 4-1 through 4-10 on pages 25 and 26, compounds 5-1 through 5-42 on pages 28 to 36, and compounds 6-1 through 6-7 on pages 39 and 40 of the Publication; compounds represented by general formula (I) and general formula (2) in Japanese Patent Publication Open to Public Inspection No. 6-289520, specifically, compounds (1-1) through (1-17) and (2-1) on pages 5 to 7 of the Publication; compounds described in (Ka 2) and (Ka 3) of Japanese Patent Publication Open to Public Inspection No. 6-313936, specifically, compounds described on pages 6 to 19 of the Publication; compounds described in (Ka 1) of Japanese Patent Publication Open to Public Inspection No. 6-313951, specifically, compounds described on pages 3 to 5 of the Publication; compounds represented by general formula (I) in Japanese Patent Publication Open to Public Inspection No. 7-5610, specifically, compounds I-1 through I-38 described on pages 5 to 10 of the Publication; compounds represented by general formula (II) in Japanese Patent Publication Open to Public Inspection No. 7-77783, specifically, compounds II-1 through II-102 described on pages 10 to 27 of the Publication; and compounds represented by general formula (H) and general formula (Ha) in Japanese Patent Publication Open to Public Inspection No. 7-104426, specifically, compounds H-1 through H-44 described on pages 8 to 15 of the Publication.

A hydrazine derivative addition layer is a photosensitive layer and/or a constitution layer adjacent to the photosensitive layer. The added amount is preferably in the range of $10^{-6}$ to $10^{-1}$ mole per mole of silver halide and is most preferably in the range of $10^{-5}$ to $10^{-2}$ mole, though the optimum amount is not defined, depending on the silver halide grain size, halide composition, chemical sensitization degree, reducing agent type, retarder type, etc.

Hydrazine compounds according to the invention may be dissolved in a suitable organic solvent such as, for example, alcohols (methanol, ethanol, propanol, and fluorinated alcohol), ketones (acetone, methyl ethyl ketone), dimethylformamide, dimethyl sulfoxide, methyl cellosolve, etc. and then employed. Furthermore, employing an emulsification dispersion method which has been well known, hydrazine compounds are dissolved in oils such as dibutyl phthalate, tricresyl phthalate, glyceryl triacetate, diethyl phthalate, etc., and auxiliary solvents such as ethyl acetate, cyclohexane, etc., and can be employed upon mechanically preparing emulsified dispersion. Alternatively, employing a method which has been known as a solid dispersion method, the hydrazine compound powders can be dispersed into water using a ball mill, a colloid mill or supersonic wave and then employed.

In combination with hydrazine compounds, into the photosensitive material according to the invention, incorporated can be nucleation accelerating agents such as amine derivatives, onium salts, disulfide derivatives, hydroxylamine derivatives, etc.

In the present invention, to improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14 through 20, are preferably used.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in Research Disclosure Item 17029 (on page 9 to 15, June, 1978) and can be employed.

Binders suitable for the thermally developable photosensitive material according to the present invention are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic.

To protect the surface of the photosensitive material and to prevent abration marks, it is possible to coat a non-photosensitive layer upon a photosensitive layer. Kind of a binder used for the non-photosensitive layer may be the same as that used for the photosensitive layer or different from that used for the photosensitive layer.

In the present invention, with the purpose of accelerating the thermal development speed, the amount of the binder in a photosensitive layer is preferably between 1.5 and 10 $g/m^2$, and is more preferably between 1.7 and 8 $g/m^2$. When the amount is below 1.5 $g/m^2$, the density of an unexposed part markedly increases to occasionally cause no commercial viability.

Supports employed in the present invention are preferably, in order to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics (hereinafter referred to as SPS) comprising styrene series polymers having a syndiotactic structure. The thickness of the support is between about 50 and about 300 $\mu$m, and is preferably between 70 and 180 $\mu$m. Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, preferably by not less than 35° C. and more preferably by at least 40° C. However, when the supports are heated at a temperature higher than the melting point, no advantages of the present invention are obtained.

Plastics employed in the present invention are described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in Japanese Patent Publication Open to Public Inspection No. 3-131843.

As the base casting method of the support and subbing production method which are associated with the present invention, any of those known in the art can be employed. However, those methods described in paragraphs [0030] through [0070] of Japanese Patent Publication Open to Public Inspection No. 9-50094 are preferably employed. In the present invention, solvents include ketones such as acetone, iso-phorone, ethylamyl ketone, methylethyl ketone, methy-iso-butyl ketone, etc.; alcohols such as methyl alcohol, ethyl alcohol, n-propyl alcohol, iso-propyl alcohol, n-butyl alcohol, iso-butyl alcohol, diacetone alcohol, cyclohexanol, benzyl alcohol, etc.; glycols such as ethylene glycol, diethylene glycol, triethylene glycol, propylene glycol, hexylene glycol, etc.; etheralcohols such as ethyleneglycol monomethylether, diethyleneglycol monomethylether, etc.; ethers such as ethylether, dioxane, iso-propylether, etc.; esters such as ethyl acetate, butyl acetate, amyl acetate, iso-propyl acetate, etc.; hydrogen carbons such as n-pentane, n-hexane, n-heptane, cyclohexane, benzene, toluene, xylene, etc.; chlorinated compounds such as methyl chloride, methylene chloride, chloroform, dichlorobebzene, etc.; amines such as monomethylamine, dimethylamine, triethanolamine, ethylenediamine, triethylamine, etc. As other solvents, are cited water, formamide, dimethylformamide, nitromethane, pyridine, toluidine, tetrahydrofuran, acetic acid, etc. However the solvents are not limited thereto. These solvents can be used singly or in combination of 2 kinds or more. The content of these solvents in the photosensitive material can be adjusted according to condition variation such as temperature condition variation in drying process after coating process. The content of these solvents can be detected employing a gas chromatography under the condition suitable for detection of the content of added solvents. The total amount of the solvents added in the photosensitive material of the present invention is preferably adjusted to be 5 to 1000 $mg/m^2$, more preferably 10 to 300 $mg/m^2$. With the content in the above-mentioned range, the photosensitive material with high sensitivity and low fog density can be obtained.

The thermally developable photosensitive material according to the invention, to which the present invention is applied, is subjected to formation of photographic images employing thermal development processing and preferably comprises a reducible silver source (organic silver salt), a photosensitive silver halide with an catalytically active amount, a hydrazine derivative, a reducing agent and, if desired, an image color control agent, to adjust silver tone, which are generally dispersed into a (organic) binder matrix.

The thermally developable photosensitive material according to the invention is stable at normal temperatures and is developed, after exposure, when heated (for example, to 80 to 140° C.). Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally developable photosensitive material according to the invention comprises a support having thereon at least one photosensitive layer, and the photosensitive layer may only be formed on the support. Further, at least one nonphotosensitive layer is preferably formed on the photosensitive layer. In order to control the amount or wavelength distribution of light transmitted through the photosensitive layer, a filter layer may be provided on the same side as the photosensitive layer, and/or an antihalation layer, that is, a backing layer on the opposite side. Dyes or pigments may also be incorporated into the photosensitive layer. As the usable dyes, those which can absorb aimed wavelength in desired wavelength region can be used, preferred are compounds described in JP-A Nos. 59-6481, 59-182436, U.S. Pat. No. 4,594,312, European Patent Publication Nos. 533,008, 652,473, JP-A Nos. 2-216140, 4-348339, 7-191432, 7-301890.

Furthermore, these nonphotosensitive layers may contain the above-mentioned binder, a matting agent and a lubricant such as a polysiloxane compound, a wax and a liquid paraffin.

The photosensitive layer may be composed of a plurality of layers. Furthermore, for gradation adjustment, in terms of sensitivity, layers may be constituted in such a manner as a fast layer/slow layer or a slow layer/fast layer.

Details of the thermally developable photosensitive materials are disclosed, as described above, in, for example, in U.S. Pat. Nos. 3,152,904 and 3,457,075, and D. Morgan, `lDry Silver Photographic Materialî and D. Morgan and B. Shely, fThermally Processed Silver Systemsî (Imaging Processes and Materials) Neblette, 8th Edition, edited by Sturge, V. Walworth, and A. Shepp, page 2, 1969), etc. Of these, the thermally developable photosensitive material used in the invention is characterized in that they are thermally developed at temperature of 80 to 140° C. so as to obtain images without fixation, so that the silver halide and the organic silver salt in an unexposed portion are not removed and remain in the photosensitive materials.

In the present invention, it is preferred that optical transmission density of the photosensitive material including a support at 400 nm after thermally developed is preferably not more than 0.2, more preferably 0.02 to 0.2. With the optical transmission density of less than 0.02, sensitivity is too low to meet a practical use.

EXAMPLE

The present invention is explained with reference to an example below. However, the present invention is not limited to this example.

Example 1

<Preparation of a support>

Both sides of a 175 μm thick PET film colored by blue of density of 0.170 (measured by a densitometer PDA-65, produced by Konica Co.) were subjected to corona discharge at 8 w/m$^2$ for 1 minute.

<Coating a back layer side>

To 830 g of methylethyl ketone being stirred were added 84.2 g of celluloseacetatebutylate (CAB381-20, produced by Eastman Chemical Co.) and 4.5 g of polyester resin (Vitel PE2200B, produced by Bostic Co.) and these additives were dissolved. To thus obtained solution were added 0.30 g of infrared dye 1, 4.5 g of fluorine containing type surfactant (Surflone KH40, produced by Asahi glass Co.) and 2.3 g of fluorine containing type surfactant (Megafack F120K, produced by Dainippon Ink Co.) dissolved in 43.2 g of methanol. The above obtained solution was sufficiently stirred so as to dissolve all components. Finally, to the above obtained solution was added 75 g of silica (Siloid 64X6000, produced by W. R. Grace Co.) dispersed in 1 wt % in methylethyl ketone employing a dissolver type homogenizer and thus obtained solution was stirred so as to prepare a coating solution for a back layer. Thus prepared coating solution for the back layer is coated employing an extrusion coater and dried so as to obtain dry thickness of 3.5 μm. Drying was conducted employing dry wind having dry temperature of 100° C. and dew point temperature of 10° C. for 5 minutes.

| <Preparing a photosensitive silver halide emulsion A> | |
|---|---|
| A1 | |
| Phenylcarbamoyl modified gelatin | 88.3 g |
| Compound (A) (10% methanol aqueous solution) | 10 ml |
| Potassium bromide | 0.32 g |
| Water to make 5429 ml. | |
| B1 | |
| 0.67N silver nitrate aqueous solution | 2635 ml |
| C1 | |
| Potassium bromide | 51.55 g |
| Potassium iodide | 1.47 g |
| Water to make 660 ml. | |
| D1 | |
| Potassium bromide | 154.9 g |
| Potassium iodide | 4.41 g |
| Iridium chloride (1% solution) | 0.93 ml |
| Water to make 1982 ml. | |
| E1 | |
| 0.4N potassium bromide aqueous solution An amount for controlling later mentioned silver potential | |
| F1 | |
| Potassium hydroxide | 0.71 g |
| Water to make 20 ml. | |
| G1 | |
| 56% acetic acid aqueous solution | 18.0 ml |
| H1 | |
| Sodium carbonate anhydrous | 1.72 g |
| Water to make 151 ml | |

Compound A:

$HO(CH_2CH_2O)n—[CH(CH_3)CH_2O]_{17}—(CH_2CH_2O)mH$ m+n=5 to 7

Employing a mixing stirrer described in Japanese Patent Examined Publication No. 58-58288, 58-58289, to Solution (A1) was added ¼ amount of Solution (B1) and total amount of Solution (C1) were added by controlling temperature at 45° C., pAg at 8.09 respectively by double-jet mixing method taking 4 minutes 45 seconds so as to conduct nucleus formation. 1 minute later, to the above obtained solution was total amount of Solution (F1). 6 minutes later, to thus obtained solution were added ¾ amount of Solution (B1) and total amount of Solution (D1) by controlling temperature at 45° C., pAg at 8.09 respectively by double-jet mixing method taking 14 minutes 15 seconds. After the solution was stirred for 5 minutes, the solution was cooled down to 40° C., and to the solution was added total amount of Solution (G1) so as to obtain silver halide emulsion precipitation. Supernatant fluid was removed so as to leave 2000 ml of precipitation part to which 10 l of water was added and thus obtained solution was stirred, and after stirring the silver halide emulsion was precipitated again. Thereafter, the supernatant fluid was removed so as to leave 1500 ml of precipitation part to which 10 l of water was added and thus obtained solution was stirred, and after stirring the silver halide emulsion was precipitated. After the supernatant fluid was removed so as to leave 1500 ml of precipitation part, to the precipitation was added Solution (H1), then thus obtained solution was raised up to 60° C. and stirred for 120 minutes. Finally, pH of the solution was adjusted to 5.0 and to this solution was added water so that the weight of the solution is to be 1161 g per 1 mol of silver amount. An average grain size of this emulsion is 0.058 μm, a variation coefficient of grain size is 12%, and this emulsion is composed of monodispersed cubic silver iodobromide grains having [100] plane ratio of 92%.

<Preparing a photosensitive silver halide emulsion B>

A photosensitive silver halide emulsion B was prepared in the same manner as employed in preparing the photosensitive silver halide emulsion A except that pH of the solution was finally adjusted to 5.8.

<Preparing powdery organic silver salt A and B>

In 4720 ml of deionized water were dissolved 130.8 g of behenic acid, 67.7 g of arachidinic acid, 43.6 g of stearic acid and 2.3 g of palmitic acid at 80° C. To thus obtained solution were added 540.2 ml of 1.5M sodium hydroxide and 6.9 ml of condensed nitric acid, thereafter the obtained solution was cooled down to 55° C. so as to obtain a solution composed of sodium organic acid salts. While keeping the temperature of said solution composed of sodium organic acid salts at 55° C., to the solution were added 45.3 g of the above obtained photosensitive silver halide emulsion A (and photosensitive silver halide emulsion B) and 450 ml of deionized water and thus obtained solution was stirred for 5 minutes. Next, to thus obtained solution was added 702.6 ml of 1M silver nitrate solution taking 2 minutes and the obtained solution was stirred for 10 minutes so as to obtain organic silver salt dispersion. Thereafter, the obtained organic silver salt dispersion was moved into washing vessel and to this dispersion was added deionized water. Then this dispersion was stirred and allowed to be left quietly so that the organic silver salt dispersion was supernatant and under aqueous phase composed of water soluble salts was removed. The supernatant organic silver salt dispersion was repeatedly washed with deionized water and drained until the electroconductivity of the drainage is to be 2 μS/cm, then dehydrated by centrifuge. Thus obtained organic silver salt dispersion is dried employing warm ciculating dryer at 40° C. until weight loss of the organic silver salt dispersion can not be observed so as to obtain the powdery organic silver salt A and the powdery organic silver salt B respectively.

<Preparing powdery organic silver salts C and D>

The powdery organic silver salt C and D were prepared in the same manner as employed in preparing the powdery organic silver salt A and B except that after the silver halide emulsion was added, the solution containing the silver halide emulsion was stirred for 5 minutes employing a homogenizer (ULTRE-TURRAX T-25, produced by IKA JAPAN Co.) at 13200 rpm (mechanical vibration frequency of 21.1 kHz).

<Preparing a photosensitive emulsion dispersing solution 1 to 4>

In 1457 g of methylethyl ketone (MEK) was dissolved 14.57 g of polyvinylbutyral powder (Butvar B-79, produced by Monsanto Co.), and thus obtained solution was stirred employing a dissolver (DISPERMAT CA-40M, produced by VMA-GETZMANN Co.). While being stirred in order to sufficiently mix the ingredients, to thus obtained solution was gradually added 500 g of the powdery organic silver salts A, B, C, D respectively so as to obtain each slurry. The said slurry, of which flowing amount was arranged so that the staying time in a mill of said slurry was to be 3 minutes, was supplied employing a pump to a medium type dispersing equipment (DIPERMAT SL-C12EX type, produced by VMA-GETZMANN Co.) in which 0.5 mm zirconia beads (produced by Toray Co.) were charged in an amount of 80 wt % and dispersed at mill circumferential rate of 13 m/s so as to prepare the photosensitive emulsion dispersing solution 1 to 4.

<Preparing a stabilizing solution>

A stabilizing solution was prepared by dissolving 1.0 g of stabilizer 1 and 0.31 g of potassium acetate in 4.97 g of methanol.

<Preparing a infrared spectral sensitizing dye solution>

A infrared spectral sensitizing dye solution was prepared by dissolving 19.2 mg of infrared spectral sensitizing dye 1, 1.488 g of 2-chlorobenzoic acid, 2.779 g of stabilizer 2 and 365 mg of 5-methyl-2-mercaptobenzimidazole in 31.3 ml of MEK in a dark room.

<Preparing an adding solution a>

An adding solution a was prepared by dissolving 27.98 g of developer 1, 1.54g of 4-methylphthalic acid and infrared dye 1 in 110 g of MEK.

<Preparing an adding solution b>

An adding solution b was prepared by dissolving 3.56 g of antifoggant 2 and 3.43 g of phthalazine in 40.9 g of MEK.

<Preparing a photosensitive layer coating solution 1 to 4>

To 50 g of the above-mentioned photosensitive emulsion dispersing solution 1 to 4 was added 15.11 g of MEK, and the obtained solution was stirred at 21° C., thereafter to the soution was added 390 μl of antifoggant 1 (10% methanol solution), and the obtained solution was stirred for 1 hour. Further, to thus obtained soution was added 494 μl of potassium bromide (10% methanol solution), and the obtained solution was stirred for 20 minutes. Subsequently to thus obtained soution was added 167 mg of stabilizer solution, and the obtained solution was stirred for 10 minutes, 2.622 g of infrared spectral sensitizing dye was added to the solution which was stirred for 1 hour. Thereafter, the temperature of the solution was cooled down to 13° C. and the solution was stirred for 30 minutes. While keeping the temperature of the solution at 13° C., to the solution was added 13.31 g of polyvinyl butyral (Butvar B-79, produced by Monsanto Co.) and the solution was stirred for 30 minutes, then to the above obtained solution was added 1.084 g of tetrachlorophthalic acid (9.4 wt % of MEK solution) and the solution was stirred for 15 minutes. Keeping still more stirring, to the solution were added 12.43 g of the adding solution a, 1.6 ml of aliphatic isocyanate (Desmodur N3300, produced by Morbey Co., 10% MEK solution) and 4.27 g of the adding solution b in this order and thus obtained solution was stirred so as to obtain the photosensitive layer coating solution 1 to 4.

<Preparing a photosensitive layer coating solution 5 to 8>

The photosensitive layer coating solution 5 to 8 were prepared in the same manner as employed in preparing the photosensitive layer coating solution 1 to 4 except displacing the stirrer with dissolver type homogenizer at 1000 rpm.

<Preparing a matting agent dispersing solution>

7.5 g of celluloseacetatebutylate (CAB171-15, produced by Eastman Chemical Co.) was dissolved in 42.5 g of methylethyl ketone, and to thus obtained solution was added 5 g of calcium carbonate (Super-Pflex 200, produced by Speciality Minerals Co.) and the solution was dispersed for 30 minutes employing a dissolver type homogenizer at 8000 rpm so as to prepare the matting agent dispersing solution.

<Preparing a surface protective layer coating solution>

In 865 g of methylethyl ketone being stirred were dissolved 96 g of celluloseacetatebutylate (CAB171-15, produced by Eastman Chemical Co.), 4.5 g of polymethylmethacrylic acid (Palide A-21. produced by Roam & Haas Co.), 1.5 g of vinylsulfone compound, $CH_2{=}CHSO_2CH_2CH(OH)CH_2SO_2CH{=}CH_2$, 1.0 g of benzotriazole and 1.0 g of fluorine containing surfactant (Surflone KH40, produced by Asahi Glass Co.). Next, to the above obtained solution was added 30 g of the matting agent dispersing solution and thus obtained solution was stirred to prepare the surface protective layer coating solution.

<Coating a photosensitive layer side>

The above-mentioned photosensitive layer coating solution 1 to 8 and the surface protective layer coating solution were simultaneously coated employing an extrusion coater to obtain the photosensitive material 1 to 8. Coating was conducted so as to obtain the photosensitive layer having coated silver amount of 1.9 g/m$^2$ and the surface protective layer having dry thickness of 2.5 $\mu$m, thereafter drying was conducted employing dry wind having dry temperature of 75° C. and dew point temperature of 10° C. for 10 minutes.

<Exposure and developing process>

To the emulsion layer side of the above obtained photographic material was given an exposure by a laser scanning employing an exposing equipment which has a exposing source being composed of a longitudinally multi moded semiconductor laser of 800 to 820 nm wavelength by superimposed high frequency wave. Then, employing an automatic developing processor having a heat drum and bringing the protective layer of the photosensitive material in contact with the drum surface, the thermal development was conducted at 123° C. for 16 seconds. At that time, exposure and development were carried out in a controlled room at temperature of 23° C. and RH of 50%. The obtained images were evaluated by densitometer. Sensitivity (the reciprocal of the ratio of an exposure amount to give density greater than 1.0 above unexposed portion) and maximum density were evaluated, and relative sensitivity is shown in Table 1 when the sensitivity of the photosensitive material 1 is to be 100.

<Measurement of the content of solvent contained in the film>

A film area of 46.3 cm$^2$ was cut off and then it was cut minutely into 5 mm squares. These squares were placed in a bayer bottle and shut tightly using a septum and an aluminium cap and the bottle was set to head space sampler, HP7694 produced by Hewlett Packard Co. Gas chromatography (GC) connected with the head space sampler was equipped with hydrogen flame ion detector (FID, 5971 type produced by Hewlett Packard Co.). Major measuring conditions include, head space sampler heating condition was 120° C., 20 minutes: GC introduction temperature was 120° C.: column was DB-624 produced by J&W Co.: raising rate of temperaturewas 45° C., 3 min.→100° C. (8° C./min.). Target solvents to be measured were MEK and methanol. Each calibration curve for each solvent diluted in butylalcohol was made by the gas chromatography under the measuring condition mentioned above. Employing these calibration curves, content of solvents contained in the film was obtained. The results are shown in Table 1.

<Measurement of the content of zirconium (Zr) in the film>p 10 cm×10 cm of film was cut off and the photosensitive layer was removed by using MEK and it was decomposed by mixture of sulfuric acid and nitric acid employing micro digest A300 type microwave type wet decomposition equipment produced by Prolabo Co. The content of Zr was measured by the calibration curve method employing PQ-Ω type ICP-MS (induced connection plasma mass spectrometry) produced by VG Elemental Co. The results are shown in Table 1.

TABLE 1

| Photosensitive material | Sensitivity | Maximum density | Dispersibility of photosensitive silver halide (%) | Degree of photosensitive silver halide grains contacting with organic silver grains (%) | Content of solvent (mg/m$^2$) | Content of Zr (mg/Ag 1 g) | Remarks |
|---|---|---|---|---|---|---|---|
| 1 | 100 | 100 | 90 | 88 | 75 | 0.05 | Comparison |
| 2 | 101 | 99 | 85 | 90 | 88 | 0.04 | Comparison |
| 3 | 108 | 101 | 79 | 92 | 63 | 0.05 | Invention |
| 4 | 110 | 105 | 75 | 96 | 79 | 0.06 | Invention |
| 5 | 100 | 101 | 84 | 94 | 33 | 0.05 | Invention |
| 6 | 102 | 106 | 82 | 97 | 45 | 0.05 | Invention |
| 7 | 115 | 108 | 73 | 98 | 48 | 0.06 | Invention |
| 8 | 120 | 116 | 70 | 99 | 50 | 0.04 | Invention |

Antifoggant 1

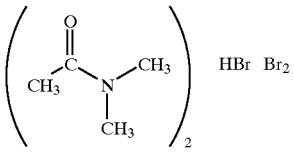

-continued

Stabilizer 1

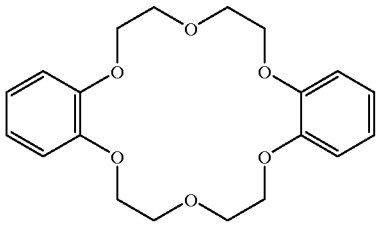

Infrared spectral sensitizing dye 1

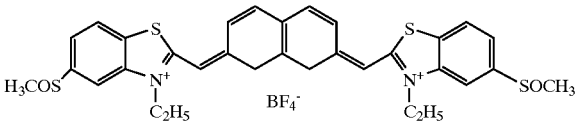

Developer 1

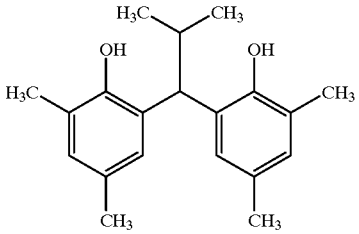

Infrared dye 1

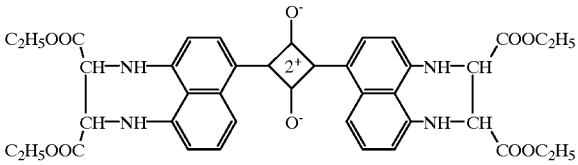

Stabilizer 2

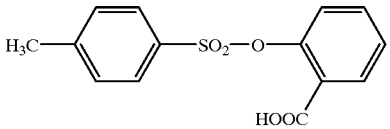

Antifoggant 2

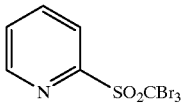

(Evaluation of dispersivility of the photosensitive silver halide grains and contacting degree of the photosensitive silver halide grains with the organic silver grains)

As a transmission electron microscope (TEM), JEM-2000FX produced by Nihondenshi Co. was used at an accelerating voltage of 200 kV. The dispersibility of the photosensitive silver halide grains was obtained through image-processing after photographing 1150 cells around the photosensitive silver halide grains, and the contacting degree of the silver halide grains with the organic silver grains was obtained by visually counting an enlarged TEM photograph in which 800 photosensitive silver halide grains were photographed. The results obtained for both the dispersibility and the contacting degree are also shown in Table 2.

TABLE 2

| | Sensitivity | Maximum density | Dispersibility of photosensitive silver halide (%) | Degree of photosensitive silver halide grains contacting with organic silver grains (%) | Remarks |
|---|---|---|---|---|---|
| Photosensitive material 1 | 100 | 100 | 90 | 88 | Comp. |
| Photosensitive material 2 | 101 | 99 | 85 | 89 | Comp. |
| Photosensitive material 3 | 108 | 101 | 79 | 92 | Inv. |
| Photosensitive material 4 | 110 | 105 | 75 | 96 | Inv. |
| Photosensitive material 5 | 100 | 105 | 82 | 95 | Inv. |
| Photosensitive material 6 | 106 | 108 | 78 | 97 | Inv. |
| Photosensitive material 7 | 115 | 116 | 73 | 99 | Inv. |
| Photosensitive material 8 | 120 | 115 | 70 | 99 | Inv. |

As can be seen from Table 1, enhancement of the dispersibility is mainly responsible for the improvement of the sensitivity, and increase of the contacting degree is mainly responsible for the improvement of the maximum density. According to the present invention, it is obvious to obtain the photosensitive material with high sensitivity when exposed and high image density.

What is claimed is:

1. A thermally developable photosensitive material comprising photosensitive silver halide grains, an organic silver salt, a reducing agent and a binder, wherein said photosensitive silver halide grains have a grain size of not less than 0.02 $\mu$m, measured from an exposing side of said thermally developable photosensitive material and have a dispersibility of not more than 80%.

2. The thermally developable photosensitive material of claim 1, wherein previously prepared photosensitive silver halide grains mixed with said organic silver salt are monodispersed silver halide grains.

3. The thermally developable photosensitive material of claim 1, wherein a photosensitive layer contains zirconium in an amount of 0.005 to 0.5 mg per 1 g of silver.

4. The thermally developable photosensitive material of claim 1, wherein said thermally developable photosensitive material contains 5 to 1000 mg/m$^2$ of solvent.

5. The thermally developable photosensitive material of claim 1 comprising a photosensitive layer containing the silver halide grains and the organic silver salt.

6. The thermally developable photosensitive material of claim 5 wherein the photosensitive layer contains the binder in amount of 1.5 to 10 g/m$^2$.

7. The thermally developable photosensitive material of claim 6 wherein the photosensitive layer contains the reducing agent represented by General formula (A) in amount of $1\times10^{-2}$ and 10 moles per mole of silver, General formula (A)

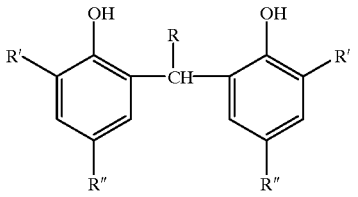

wherein R represents a hydrogen atom or an alkyl group having from 1 to 10 carbon atoms, and R' and R" each represents an alkyl group having from 1 to 5 carbon atoms.

8. The thermally developable photosensitive material of claim 6 wherein the photosensitive layer contains the organic silver salt having an average grain diameter of 0.01 to 0.8 $\mu$m.

9. The thermally developable photosensitive material of claim 6 wherein sum total of silver contained in the photosensitive layer is 0.5 to 2.2 g per $m^2$.

10. A thermally developable photosensitive material comprising photosensitive silver halide grains, an organic silver salt, a reducing agent and a binder, characterized in that not less than 95% of said photosensitive silver halide grains having grain size of not less than 0.02 $\mu$m are in contact with said organic silver salt.

11. The thermally developable photosensitive material of claim 10, wherein previously prepared photosensitive silver halide grains mixed with said organic silver salt are monodispersed silver halide grains.

12. The thermally developable photosensitive material of claim 10, wherein a photosensitive layer contains zirconium in an amount of 0.01 to 0.5 mg per 1 g of silver.

13. The thermally developable photosensitive material of claim 10, wherein said thermally developable photosensitive material contains 5 to 1000 mg/$m^2$ of solvent.

14. The thermally developable photosensitive material of claim 10 comprising a photosensitive layer containing the silver halide grains and the organic silver salt.

15. The thermally developable photosensitive material of claim 14 wherein the photosensitive layer contains the binder in amount of 1.5 to 10 g/$m^2$.

16. The thermally developable photosensitive material of claim 15 wherein the photosensitive layer contains the reducing agent represented by General formula (A) in amount of $1\times10^{-2}$ and 10 moles per mole of silver, General formula (A)

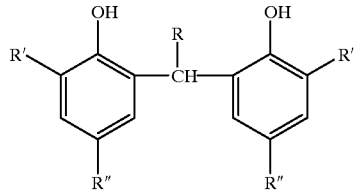

wherein R represents a hydrogen atom or an alkyl group having from 1 to 10 carbon atoms, and R' and R" each represents an alkyl group having from 1 to 5 carbon atoms.

17. The thermally developable photosensitive material from claim 16 wherein the photosensitive layer contains the organic silver salt having an average grain diameter of 0.01 to 0.8 $\mu$m.

18. The thermally developable photosensitive material of claim 17 wherein sum total of silver contained in the photosensitive layer is 0.5 to 2.2 g per $m^2$.

* * * * *